US006229269B1

(12) United States Patent
Olsen

(10) Patent No.: US 6,229,269 B1
(45) Date of Patent: May 8, 2001

(54) SYSTEM FOR AND METHOD OF OPERATING A DISCHARGE LAMP

(75) Inventor: Joseph A. Olsen, Rockport, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/316,829

(22) Filed: May 21, 1999

(51) Int. Cl.[7] ..... G05F 1/00

(52) U.S. Cl. ..... 315/291; 315/246; 315/209 R; 315/224

(58) Field of Search ..... 315/291, 248, 315/246, 300, 302, 80, 82, 209 R, 307, DIG. 7, 244, 224

(56) References Cited

U.S. PATENT DOCUMENTS

| | | | |
|---|---|---|---|
| 4,480,213 | 10/1984 | Lapatovisch et al. | 315/248 |
| 4,492,898 | 1/1985 | Lapatovich et al. | 315/248 |
| 4,636,692 | 1/1987 | Lapatovich et al. | 315/248 |
| 4,647,821 | 3/1987 | Lapatovich et al. | 315/248 |
| 4,850,918 | 7/1989 | English et al. | 445/40 |
| 5,047,695 | 9/1991 | Allen et al. | 315/291 |
| 5,134,345 | 7/1992 | El-Hamamsy et al. | 315/248 |
| 5,198,727 | 3/1993 | Allen et al. | 315/291 |
| 5,306,987 | 4/1994 | Dakin et al. | 315/248 |
| 5,363,015 | 11/1994 | Dakin et al. | 315/638 |
| 5,365,151 | 11/1994 | Spiegel et al. | 315/209 R |
| 5,394,057 | 2/1995 | Russell et al. | 315/635 |
| 5,436,533 | 7/1995 | Fromm et al. | 315/246 |
| 5,479,072 | 12/1995 | Dakin et al. | 315/638 |
| 5,483,126 | 1/1996 | Boenigk et al. | 315/307 |
| 5,508,592 * | 4/1996 | Lapatovich et al. | 315/248 |
| 5,523,655 | 6/1996 | Jennato et al. | 315/246 |
| 5,565,741 | 10/1996 | Jennato et al. | 315/246 |
| 5,592,052 * | 1/1997 | Maya et al. | 315/291 |
| 5,666,031 | 9/1997 | Jennato et al. | 315/246 |
| 5,684,367 | 11/1997 | Moskowitz et al. | 315/246 |

FOREIGN PATENT DOCUMENTS

| | | | |
|---|---|---|---|
| 0439861 A1 | 8/1991 | (EP) | H05B/41/392 |
| 0507533 A2 | 10/1992 | (EP) | H01J/65/00 |
| 0744883 A1 | 11/1996 | (EP) | H05B/41/29 |
| 9-260071 * | 10/1997 | (JP) . | |

OTHER PUBLICATIONS

1 Stromberg et al., Excitation of Acoustic Instabilities in Discharge Lamps with Pulsed Supply Voltage, Lighting Research & Technology, v. 15, N.3 127–132 (1983).

* cited by examiner

*Primary Examiner*—Haissa Philogene
*Assistant Examiner*—Ephrem Alemu
(74) *Attorney, Agent, or Firm*—Robert F. Clark

(57) ABSTRACT

A method of and system for operating a high intensity discharge lamp having an electronic ballast system is provided wherein the power supplied to the discharge lamp is increased by bending the arc in the arc tube in order to increase the length of the arc. Bending may be effected by injecting acoustic frequencies in the power supplied to the discharge lamp.

3 Claims, 5 Drawing Sheets

SYSTEM FOR AND METHOD OF OPERATING A DISCHARGE LAMP

TECHNICAL FIELD

The present invention relates to a system for and method of operating a discharge lamp, and more particularly, to increasing the lamp voltage and power by bending the arc in an arc tube of a discharge lamp to increase the length of the arc.

BACKGROUND ART

Generally, a typical High Intensity Discharge (HID) lamp has a fixed lamp voltage load. Under some circumstances, it is desired to deliver to the lamp more power than normal. For example, in some lamp applications it is desired to provide fast lamp warm-up. The amount of power delivered to an HID lamp is the product of the lamp voltage and the current supplied by the ballast. The current available from a conventional electronic ballast is typically limited by its current carrying switching components. Therefore, using such a current limited ballast with a conventional fixed lamp voltage load, it has not been possible heretofore to supply more power to the lamp. Although the current supplied by the ballast can be increased by providing higher current switching components, higher current switching components are more expensive than conventional current limited ballasts. The present invention increases lamp voltage, using a conventional current limited ballast, by bending the arc in the arc tube to increase the length of the arc. For example, arc length can be increased by injecting acoustic frequencies into the waveform of the power supplied to the lamp to bend the arc.

Bending the arc to increase its length is contrary to conventional treatment of the arc in an arc tube of a discharge lamp. In particular, in conventional lamp applications provided heretofore, whenever efforts have been made to influence the arc, such efforts have involved straightening or otherwise stabilizing and centering the arc. For example, U.S. Pat. No. 5,134,345 issued on Jul. 28, 1992 to El-Hamamsy et al. illustrates a method of detecting arc instabilities in an HID lamp and changing the drive frequencies that cause them thereby avoiding acoustic frequencies that cause destabilizing phenomena.

In U.S. Pat. No. 5,306,987 issued on Apr. 26, 1994 to Dakin et al. reference is made to stabilization of HID lamps by modulating the drive signal with acoustic resonant band frequencies. A similar method of centering the arc in discharge lamps is illustrated in U.S. Pat. No. 5,198,727 which issued on Mar. 30, 1993 to Allen et al. This patent illustrates centering the arc by the "acoustic perturbations" induced by the frequency of the drive signals. Such acoustic perturbations compel the gas or vapor movement patterns within the arc tube to counter the gravity-induced convection.

U.S. Pat. No. 5,684,367 which issued on Nov. 4, 1997 to Moskowitz et al. illustrates a system for and method of operating a discharge lamp, and in particular, of stabilizing and controlling the characteristics of discharge lamps by amplitude-modulating the input AC power wave with a periodic waveform and/or pulse wave to control stabilization and color characteristics. This patent is commonly owned with the instant application and is incorporated herein by reference.

In U.S. Pat. No. 5,047,695 which issued on Sep. 10, 1991 to Allen et al., a method and ballast circuit is illustrated for operating fluorescent, mercury vapor, sodium and metal halide lamps in a DC mode. Power modulation for creating acoustic pressure waves for arc straightening is referred to in this patent. The lamp illustrated therein is operated with a selectable amount of ripple imposed to provide for acoustically straightening the arc between the lamp electrodes. A related patent is the aforementioned 5,198,727 patent.

All of the foregoing patents relate to straightening or otherwise stabilizing and centering the arc in an arc tube in a discharge lamp. In contrast, the present inventors have developed a new method and system for operating a discharge lamp wherein more power may be supplied to a fixed lamp voltage load by bending the arc to increase the arc length and therefor the lamp voltage. None of the foregoing references illustrate this feature. Bending of the arc to increase arc length may be effected, for example, using acoustic frequencies, and in particular by exciting particular acoustic resonances in the gas in the arc tube thereby causing the arc to bend.

DISCLOSURE OF THE INVENTION

It is an object of the present invention to provide an improved method of and system for operating a discharge lamp.

Another object of the present invention is to obviate the disadvantages of the prior art by providing an improved method of and system for increasing lamp voltage using a current limited ballast.

Yet another object of the present invention is to provide an improved method of and system for operating a discharge lamp by supplying more power to a fixed voltage lamp load.

A further object of the present invention is to use acoustic frequencies to increase power input when operating a discharge lamp.

It is still another object of the present invention to achieve the foregoing objectives using a smaller and less costly electronic ballast.

This invention achieves these and other objects by providing a system and a method useful in the operation of a discharge lamp. In particular, a discharge lamp is supplied with an input waveform to power the lamp, and the arc formed within the discharge lamp is bent to lengthen the arc and thereby increase lamp power. In one embodiment, acoustic frequencies are injected into the power waveform supplied to the discharge lamp to bend the arc and thereby increase lamp power.

BRIEF DESCRIPTION OF THE DRAWINGS

This invention may be clearly understood by reference to the attached drawings in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
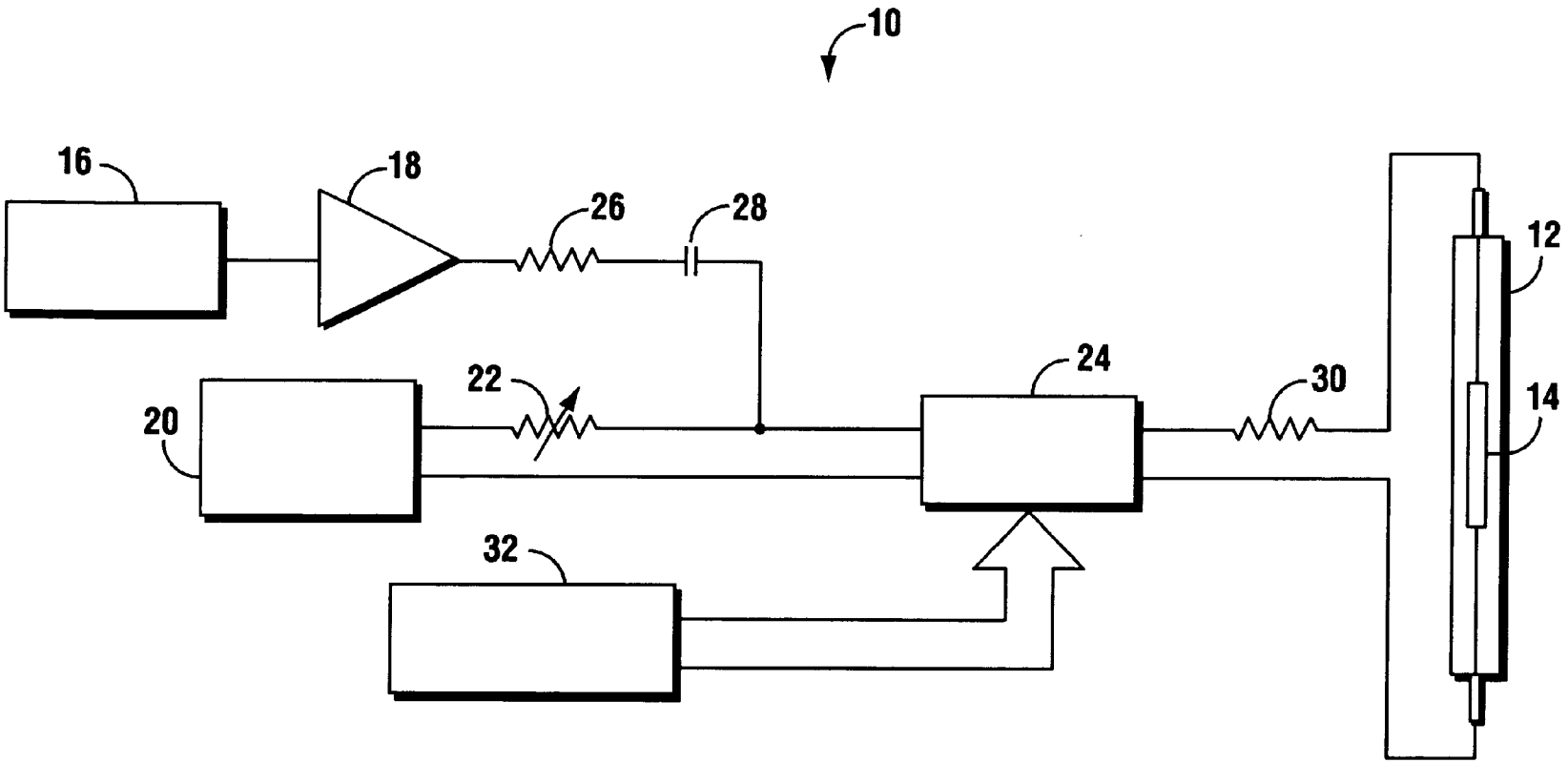
FIG. 1 is a circuit diagram of one embodiment of the present invention.

Referring to the drawings, FIG. 1 illustrates a system 10 in accordance with one embodiment of the present invention for the operation of a discharge lamp 12. The system 10 is provided for pulse-exciting a high intensity discharge lamp 12 in a manner which will bend the arc of the arc tube 14 in the lamp 12 to increase arc length thereby increasing lamp voltage and power. To this end, system 10 includes a function generator and power amplifier combination. In particular, a function generator 16 is provided coupled to a power amplifier 18. A typical function generator 16 which can be employed is a Model No. F34, manufactured by IEC. A typical power amplifier 18 which can be used is a Model No. 1140LA, manufactured by ENI.

The system 10 includes a dc power supply and resistor ballast combination. In particular, dc power supply 20 is coupled to a resistor 22 providing a series dc power supply and resistor ballast combination. A typical dc power supply 20 which can be used is a Model No. HP6035A, manufactured by Hewlett Packard. The resistor 22 is a conventional 25 Ohm non-inductive power resistor. A typical resistor 22 which can be used is a Model No. Pecos TC100PA10R00J, manufactured by Ohmite. The output of the ballast combination is capacitively coupled to the output of the function generator/power amplifier combination to provide a dc voltage which is fed to an H-bridge commutator 24. The capacitive coupling is provided by a resistor 26 and capacitor 28. The resistor 26 is a conventional 30 Ohm non-inductive power resistor. A typical resistor 26 which can be used is a Model No. Pecos TC100PA10R00J, manufactured by Ohmite. The capacitor 28 is a conventional 1 $\mu$F capacitor. A typical capacitor 28 which can be used is a Model No. 1$\mu$F/K630V, manufactured by Sprague.

The H-bridge commutator 24 is operatively coupled to the lamp 12 through a conventional in-rush limiting resistor 30. A typical resistor 30 which can be used is a Model No. CL40, manufactured by Panasonic. A pulse generator 32 is coupled to the H-bridge commutator 24 for setting the timing of the H-bridge commutator. A typical pulse generator 32 which can be used is a Model No. DG535, manufactured by Stanford Research.

The system 10 provides one embodiment of the present invention useful in controlling a lamp system by (a) supplying a discharge lamp with an input waveform to power the discharge lamp, and (b) bending the arc within the discharge lamp to increase arc length to increase lamp power. In the embodiment illustrated in FIG. 1, bending of the arc in arc tube 14 is effected by injecting acoustic frequencies into the power waveform supplied to the discharge lamp to lengthen the arc as discussed hereinafter.

In considering the operation of the system illustrated in FIG. 1, in order to inject acoustic frequencies into the power waveform supplied to the discharge lamp 12, the function generator 16 is tuned to low acoustic frequencies. The specific low frequencies which cause the increased lamp voltage will vary depending upon lamp features such as the dimensions and geometry of the arc tube and the temperature and composition of the enclosed fill. In other words, the frequencies will vary from lamp to lamp as one or more of these features vary. For example, acoustic frequencies may range between about 1kHz for general lighting-type lamps to about 200 kHz for lamps such as automobile head lamps. Regardless of the specifics of the lamp features, however, the arc may be caused to bend to increase arc length and lamp voltage in accordance with the present invention by imposing the particular acoustic frequency components in the power waveform applied to the lamp.

Figure 2A:
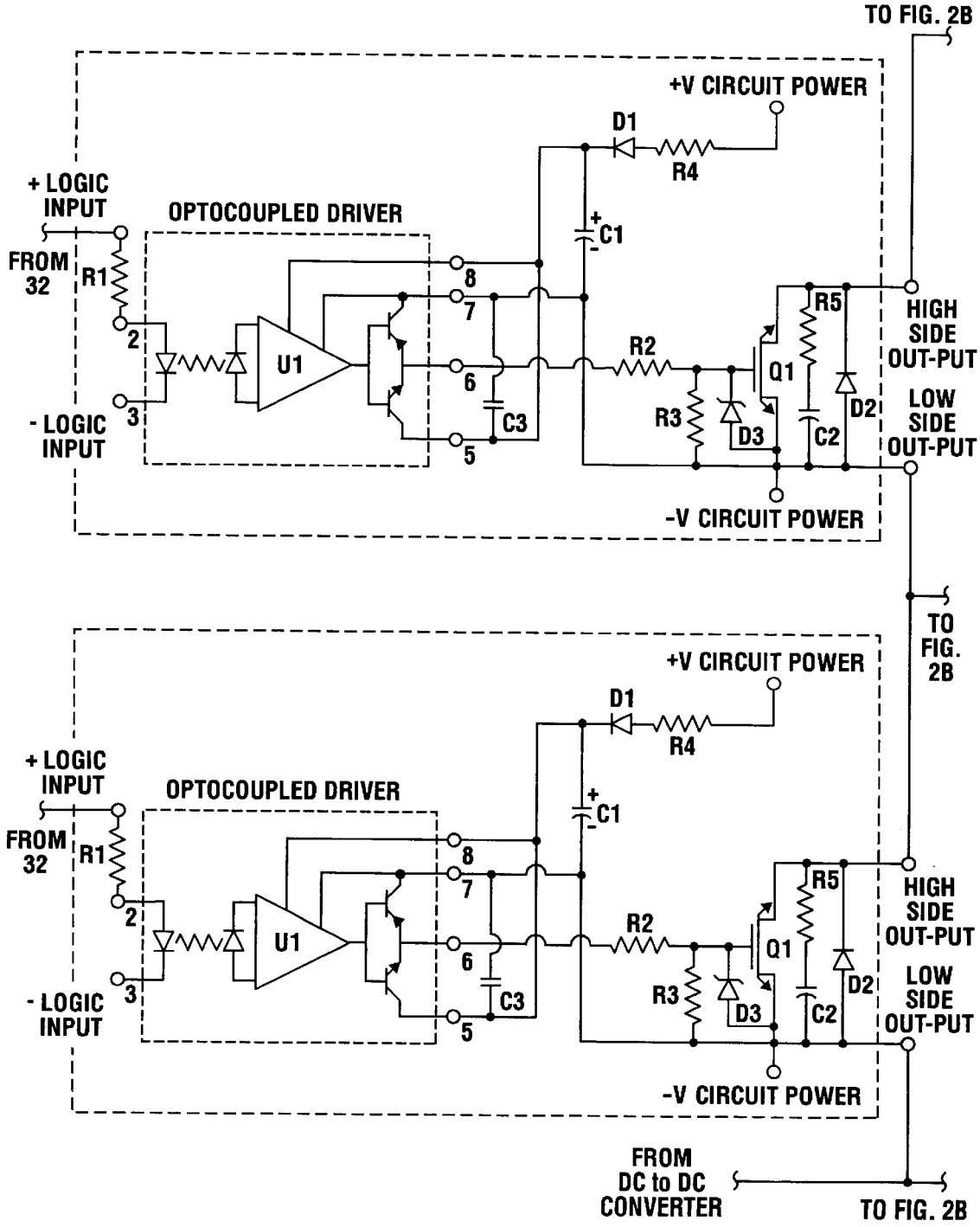
FIGS. 2A and 2B are a circuit diagram of an H-bridge commutator useful in the present invention.
Figure 2B:
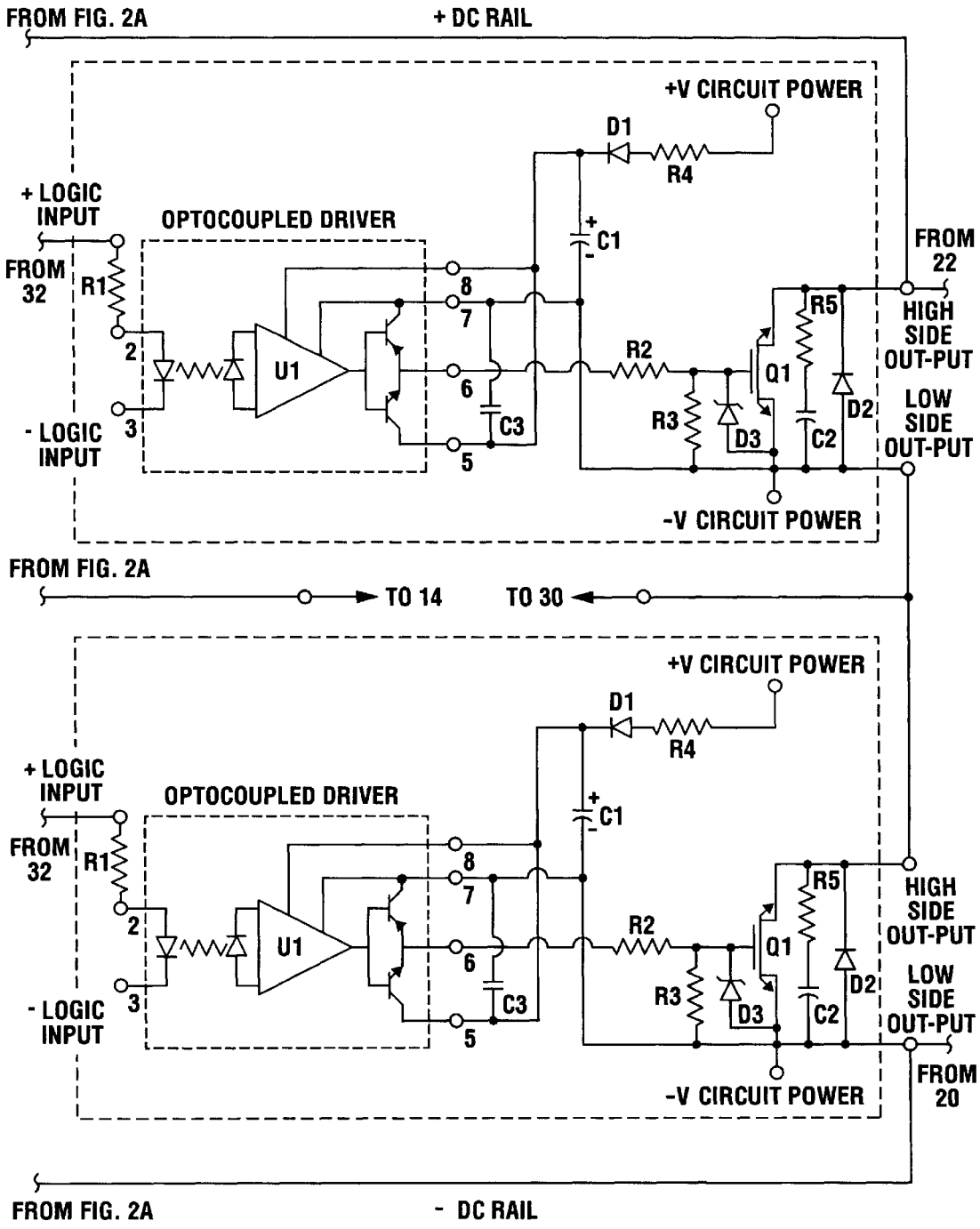
Figure 3:
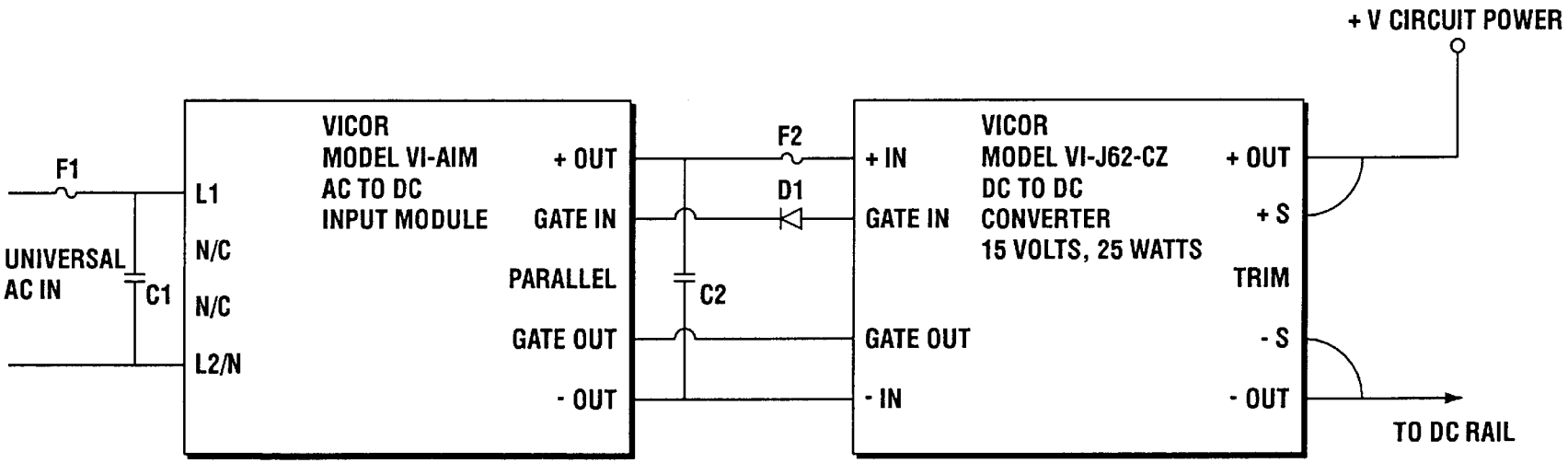
FIG. 3 is a circuit diagram of a dc circuit supply of the H-bridge commutator of FIGS. 2A and 2.
Figure 4:
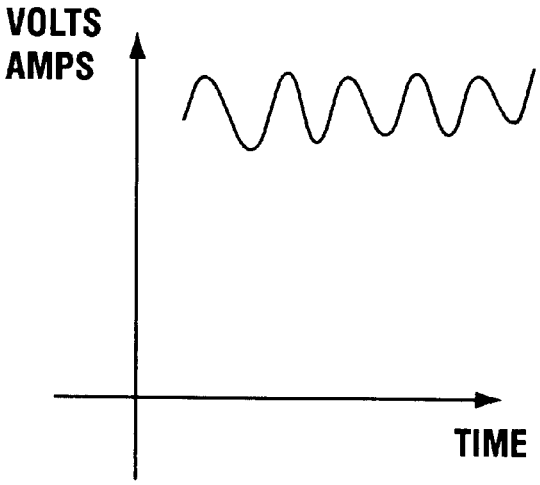
FIG. 4 is a graph illustrating a ripply d.c. voltage formed in one embodiment of the present invention.
Figure 5:
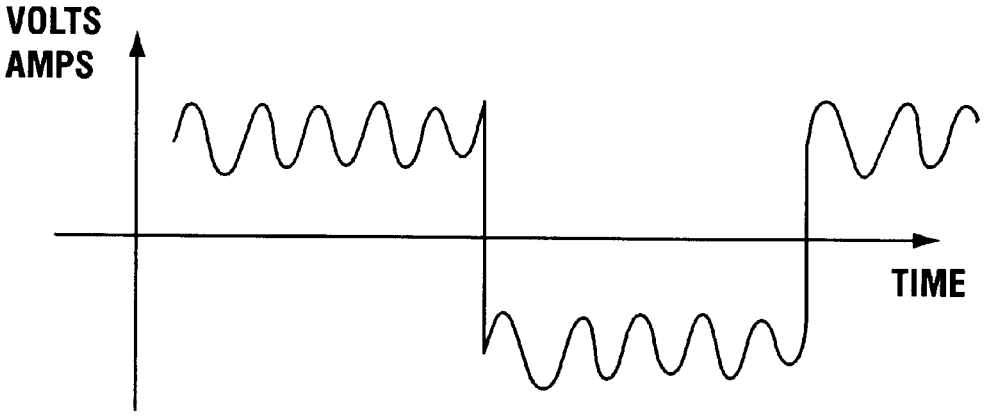
FIG. 5 is a graph illustrating an acoustically modulated square wave ballast waveform formed in one embodiment of the present invention.

In considering the embodiment illustrated in FIG. 1, the function generator 16 is tuned to low acoustic frequencies to excite the destabilizing longitudinal mode of the arc in the arc tube 14 of the discharge lamp 12. To this end, a ripply dc voltage as illustrated in FIG. 4 will be provided at an input of the H-bridge commutator 24 by capacitively coupling the power amplified acoustic waveform provided by the tuned function generator 16 and power amplifier 18 to the output of the ballast combination 20, 22. In turn, the H-bridge commutator 24 will produce an acoustically modulated square wave ballast waveform as illustrated in FIG. 5 which will be fed to the lamp 12 through the resistor 30 which provides the conventional in-rush limit. Injection of acoustic frequencies effects exciting acoustic resonances in gas in the arc tube 14 of the discharge lamp 12 which causes the arc to bend and thereby become lengthened causing the lamp voltage to increase. An example of the H-bridge commutator 24 is illustrated in FIGS. 2A and 2B (the component values for FIGS. 2A and 2B are listed in Table I). An example of a dc circuit supply for such commutator is illustrated in FIG. 3 (the component values for FIG. 3 are listed in Table II).

TABLE I

| | |
|---|---|
| R1 | 240 ohms |
| R2 | 100 ohms |
| R3 | 1000 ohms |
| R4 | 10 ohms |
| R5 | 110 ohms, 2 watts |
| D1 and D2 | MUR 8100 |
| D3 | 18 volt zener |
| BR1 | RS404L |
| VR1 | Varistor 420L20 |
| C1 | 100 $\mu$f 50V |
| C2 | 100 pf |
| C3 | 0.1 $\mu$f ceramic |
| Q1 | IRGPH40F (IGBT) |
| U1 | HP3101 |

TABLE II

| | |
|---|---|
| F1 | 5 amps |
| F2 | 2 amps |
| C1 | 0.47 $\mu$f, 200 VAC |
| C2 | 270 $\mu$f, 200 VDC |
| D1 | 1N4006 |

EXAMPLE

The system illustrated in FIG. 1, including the specific components described above, was coupled to a conventional Model No. M400/U HID lamp 12 manufactured by OSRAM SYLVANIA Inc. Lamp 12 includes a 400 Watt arc tube 14. Such a lamp requires 3 amps to warm-up to full operation. The ballast illustrated in FIG. 1 was powered to 2.5 amps in a conventional manner using the dc power supply 20. Although it was possible to ignite the lamp 12, 2.5 amps was not sufficient for the lamp to operate in a satisfactory manner. In particular, at 2.5 amps the lamp voltage would only reach 35 volts, thereby providing only 75 watts into the lamp. In operating the lamp in this manner, the lamp would not warm up enough to come up to full power.

The function generator 16 was then tuned to sweep from 8.5 kHz to 12 kHz, and the current limit was set to 2 amps. Operating in this manner, the destabilizing mode of the arc in the arc tube 14 was excited. The arc snaked and was visibly bent to such an extent that it actually bowed out to the wall of the arc tube. Lamp voltage increased to 75 volts, the actual lamp current being measured at 2.2 amps. The additional 0.2 amps current was due to the power amplifier 18.

In summary, by tuning the function generator to sweep at lower acoustic frequencies from 8.5 kHz to 12 kHz, the 400 Watt lamp 12 was started and operated at full power using a ballast powered by the dc power supply 20 which was limited to 2 amps. This could not be accomplished when it was attempted to operate the lamp 12 in a conventional manner at 2.5 amps.

Noted below in Table III are examples of various other OSRAM SYLVANIA Inc. lamps and the acoustic frequency range, in kHz, which will provide the lower acoustic frequency sweep required to bend the arc of each respective lamp arc tube to provide the increase in arc length to start and operate each lamp at full power:

TABLE III

| Lamp | Watts | Lower Frequency | Upper Frequency |
|---|---|---|---|
| M100/U/MED | 100 | 15 | 24 |
| M175/U | 175 | 12.5 | 19 |
| M250/U | 250 | 10 | 18 |
| M400/U | 400 | 8.5 | 15 |

The foregoing are but some examples, and the particular acoustic frequencies used in any specific lamp application for bending the arc to increase arc length and lamp power will depend upon the characteristics of the lamp.

The present invention is particularly applicable to HID lamps having electronic ballast systems, and electronic additions to magnetic ballast systems, including, without limitation, high pressure sodium, mercury and metal halide lamps, having low to high wattage.

Although the present invention has been described herein with respect to operation of an HID lamp wherein the arc is bent by using acoustic frequencies, other embodiments are possible. For example, bending of the arc in the arc tube to increase length of the arc and therefore lamp power may be accomplished by, without limitation, the use of magnetic fields, the use of additional electrodes and the like. In a further example, an arc tube having a size and geometry which will accommodate sufficient arc bending caused by natural convection in the lamp during start up may be provided in combination with conventional means to subsequently straighten the arc when the lamp is at full power.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed:

1. A system for the operation of a discharge lamp, comprising:

a function generator and power amplifier combination having a first output and adapted to provide a power amplified acoustic waveform at said first output;

a d.c. power supply and resistor ballast combination having a second output, said second output being capacitively coupled to said first output to provide a ripply d.c. voltage; and an H-bridge commutator operatively connectable to a discharge lamp and having an input connected to said ripply d.c. voltage, said H-bridge commutator adapted to provide an acoustically modulated square wave ballast waveform output in response to said ripply d.c. voltage.

2. The system for the operation of a discharge lamp of claim 1 further comprising an in-rush limiting resistor coupled between said H-bridge commutator and said discharge lamp.

3. The system for the operation of a discharge lamp of claim 1 further comprising a pulse generator coupled to said H-bridge commutator.

* * * * *